US006482290B1

(12) United States Patent
Cheng et al.

(10) Patent No.: US 6,482,290 B1
(45) Date of Patent: Nov. 19, 2002

(54) SWEEPING SLURRY DISPENSER FOR CHEMICAL MECHANICAL POLISHING

(75) Inventors: Hsi-Kuei Cheng, Hsinchu (TW); Yi-Wei Chang, Fengshan (TW); Li-Hsiao Chao, Yunghe (TW); Tzut Hsun Huang, Taipei (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/927,620

(22) Filed: Aug. 10, 2001

(51) Int. Cl.[7] ..... B24B 1/00; H01L 21/00
(52) U.S. Cl. ..... 156/345.12
(58) Field of Search ..... 156/345.12

(56) References Cited

U.S. PATENT DOCUMENTS 5,804,507 A * 9/1998 Perlov et al. ..... 438/692

* cited by examiner

*Primary Examiner*—Gregory Mills
*Assistant Examiner*—Sylvia R. MacArthur
(74) *Attorney, Agent, or Firm*—Tung & Associates

(57) ABSTRACT

A sweeping slurry dispensing device for use in a chemical mechanical polishing apparatus for the uniform distribution of a slurry solution on top of a polishing pad is described. The sweeping slurry dispensing device consists of a drive wheel, a dispenser wheel, a push arm, a motor means and a slurry dispensing nozzle. A first end of the push arm is pivotally attached to the outer periphery of the dispenser wheel while a distal second end equipped with a roller for rollingly engaging in outer surface of the oval-shaped drive wheel. The slurry dispensing nozzle is attached to a bottom surface of the drive wheel for dispensing the slurry solution in an arcuate path when the dispenser wheel is turned by the drive wheel.

15 Claims, 3 Drawing Sheets

SWEEPING SLURRY DISPENSER FOR CHEMICAL MECHANICAL POLISHING

FIELD OF THE INVENTION

The present invention generally relates to a chemical mechanical polishing apparatus and more particularly, relates to a sweeping slurry dispenser for use in a chemical mechanical polishing apparatus which is capable of spreading a slurry solution more uniformly on the surface of a polishing pad.

BACKGROUND OF THE INVENTION

Apparatus for polishing thin, flat semi-conductor wafers is well not in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1*a*) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 332 pivots on its base 36 for the in-situ conditioning of the pad 38 during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results form a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($Al_3O_2$)may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

Referring now to FIG. 2, wherein a perspective view of a CMP polishing station 42 is shown. The polishing station 42 consists of a conditioning head 52, a polishing pad 28, and a slurry delivery arm 54 positioned over the polishing pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

The slurry delivery arm 54 shown in FIG. 2 delivers a slurry solution to the polishing pad 28 in a stationary manner. The distribution of the slurry solution over the top surface of the polishing pad depends on the rotation of the pad. Since the slurry solution is usually dispensed at the center of the polishing platen, i.e., at the center of the polishing pad, it is difficult to spread evenly the slurry solution over the pad surface by the rotation of the pad. As a result, the amount of slurry at the edge of the polishing pad is always less than that in the center region of the pad. This leads to a higher removal rate at the center of the pad when compared to the edge portion of the pad. And furthermore, a higher polishing noise level is made during the polishing process. The problem is more severe in the newly designed polishing pads which have deeper surface grooves than the older pads, it thus becomes more difficult to spread the slurry solution uniformly on the polishing pad.

It is therefore an object of the present invention to provide a slurry dispenser for chemical mechanical polishing that does not have the drawbacks or shortcomings of the conventional slurry dispensing arms.

It is another object of the present invention to provide a slurry dispenser for chemical mechanical polishing that is capable of spreading a slurry solution more uniformly on top of a polishing pad.

It is a further object of the present invention to provide a sweeping slurry dispenser for chemical mechanical polishing that moves a slurry dispensing nozzle in an arcuate path on top of a polishing pad.

It is still another object of the present invention to provide a sweeping slurry dispenser for chemical mechanical polishing that moves a slurry dispensing nozzle in a half-circular pattern on top of a polishing pad.

It is still another object of the present invention to provide a sweeping slurry dispenser for chemical mechanical polishing by utilizing a circular dispensing wheel driven by an oval-shaped drive wheel.

It is yet another object of the present invention to provide a sweeping slurry dispenser for chemical mechanical polishing wherein the slurry dispensing nozzle sweeps in an arcuate pattern on top of a polishing pad during the slurry dispensing process.

It is still another further object of the present invention to provide a sweeping slurry dispenser for chemical mechanical polishing wherein a cam and molter arrangement is used to change a circular motion of a rotational molter to a side-to-side motion of the slurry dispensing nozzle.

It is yet another further object of the present invention to provide a sweeping slurry dispenser in a chemical mechanical polishing apparatus wherein the slurry dispensing nozzle sweeps between an edge of the polishing pad to a center of the polishing pad to provide a uniform distribution of slurry on the pad.

SUMMARY OF THE INVENTION

In accordance with the present invention, a sweeping slurry dispenser including a sweeping dispensing nozzle is used in a chemical mechanical polishing apparatus to uniformly distribute a slurry solution on top of a polishing pad.

In a preferred embodiment, a sweeping slurry dispenser in a chemical mechanical polishing apparatus can be provided which includes a drive wheel of oval shape that turns on a fixed center axis, the wheel has a first diameter and a second diameter perpendicular to each other, the first diameter is at least 50% larger than the second diameter; a dispenser wheel of circular shape that turns on a fixed center axis when driven by a push arm with an first end pivotally engaging a shaft mounted on an outer periphery of the dispenser wheel; a push arm of elongated shape that has a hollow center slot therein for engaging a guide pin fixedly attached to the CMP apparatus, a first end fixedly attached to the outer periphery of the dispenser wheel in a distal second end equipped with a roller for rollingly engaging in outer surface of the oval shaped drive wheel, the push arm is further equipped with a spring attached between the guide pin and the shaft on the dispenser wheel to facilitate the turning of the dispenser wheel; a motor means for rotating the drives wheel on the fixed center axis at a preset rotational speed; and a slurry dispensing nozzle attached to the bottom surface of the drive wheel for dispensing a slurry solution in a arcuate path when the dispenser wheel is turned by the drive wheel.

In the sweeping slurry dispenser for a CMP apparatus, the first diameter is between about 50% and about 900% larger than the second diameter, a ratio between the first diameter and the second diameter may be between about 2:1 and about 8:1. The drive wheel may have a thickness sufficiently large for the roller attached to the push arm to roll on an edge portion of the drive wheel. The spring is in a fully extended state when the shaft for fixing the position of the first end of the push arm is in a 3 o'clock or in a 9 o'clock position. The spring is in a fully compressed state when the shaft for fixing the position of the first end of the push arm is in a 6 o'clock position. The slurry dispensing nozzle traverses in a half-circular path when the dispenser wheel is turned by the drive wheel. The slurry dispensing nozzle may further traverse in a path that is substantially similar to a path of a polishing head that holds a wafer to be polished therein. The present rotational speed is between about 1 RPM and about 60 RPM.

In the sweeping slurry dispenser for use in a CMP apparatus, the drive wheel may be fabricated of aluminum, and has a first diameter of about 6 inches and a second diameter of about 2 inches. The dispenser wheel may have a diameter between about 4 inches and about 12 inches, and may be fabricated of aluminum. The push arm may have a length between about 4 inches and about 12 inches and may be fabricated of aluminum.

BRIEF DESCRIPTION OF THE DRAWINGS

FIG. 1B is a cross-sectional view of a polishing head and a polishing platen engaged together with a wafer therein between.

FIG. 1C is an enlarged, cross-sectional view of the wafer, the polishing pad and the slurry solution therein between.

DETAILED DESCRIPTION OF THE PREFERRED EMBODIMENT

Figure 1A:
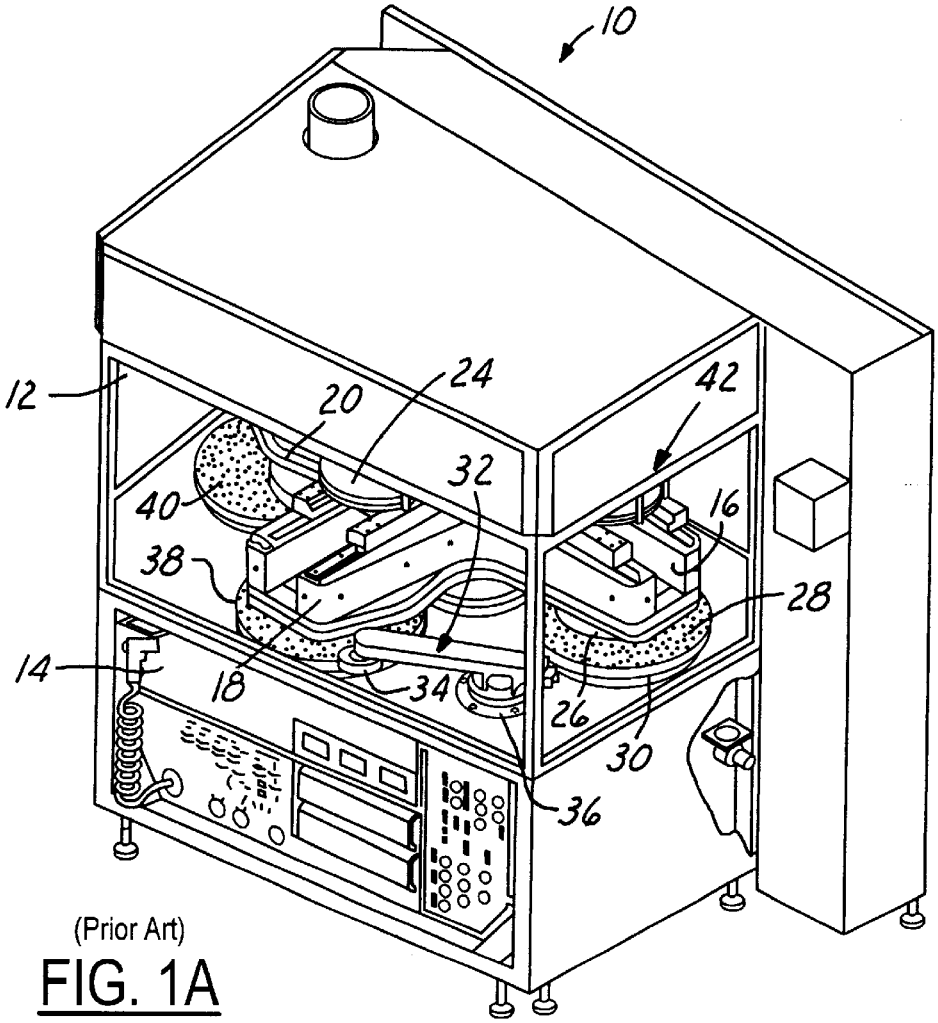
(Prior Art) FIG. 1A
FIG. 1A is a perspective view of a conventional chemical mechanical polishing apparatus illustrating multiple polishing stations.
Figure 1B:
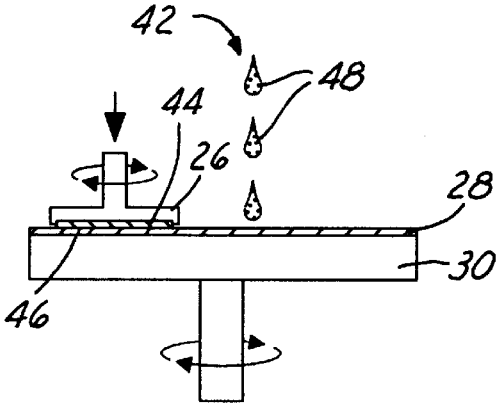
(Prior Art) FIG. 1B
Figure 1C:
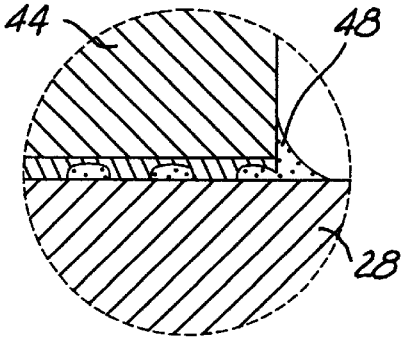
(Prior Art) FIG. 1C
Figure 2:
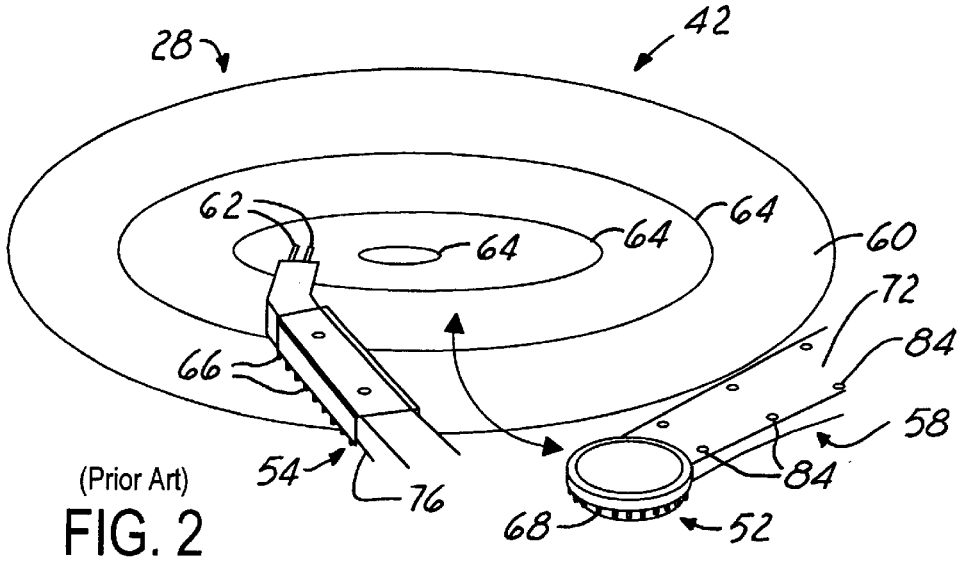
(Prior Art) FIG. 2
FIG. 2 is a perspective view of a polishing pad with a stationary slurry dispensing arm position on top in a conventional CMP apparatus.

The present invention discloses a sweeping slurry dispensing device for use in a chemical mechanical polishing apparatus that is capable of spreading a slurry solution on top of a polishing pad in a substantially more uniform manner than a slurry dispensing arm used in a conventional chemical mechanical polishing apparatus.

The present invention sweeping slurry dispensing device is constructed by a drive wheel, a dispenser wheel, a push arm, a motor and a slurry dispensing nozzle. The drive wheel is normally constructed of an oval shape that turns on a fixed center axis. The wheel has a first diameter and a second diameter wherein the first diameter is at least 50% larger than the second diameter, and preferably the first diameter is between about 50% and about 900% larger than the second diameter. It is suitable that a ratio between the first diameter and the second diameter is between 2:1 and about 8:1. The dispenser wheel is formed of circular shape that also turns on a center axis that is fixed to the CMP apparatus. When the dispenser wheel is driven by a push arm with a first end pivotally engaging a shaft mounted on an outer periphery of the dispenser wheel. The push arm is formed of elongated shape that has a hollow center slot therein for engaging a guide pin fixedly attached to the CMP apparatus such that the push arm may slide on the guide pin. The push arm has a first end fixedly attached to the outer periphery of the dispenser wheel through the shaft and pivots on the shaft, and a second distal second end equipped with a roller for rollingly engaging in outer surface of the oval shaped drive wheel. The push arm may further be equipped with a spring attached between the guide pin and the shaft on the dispenser wheel to facilitate the turning of the dispenser wheel. The motor means is used to the drive the drive wheel at a preset rotational speed, for instance, at a speed between about 1 RPM and about 60 RPM. The slurry dispensing nozzle can be attached to a bottom surface of the drive wheel for dispensing a slurry solution in an arcuate path, i.e., in a path-circular path when the dispenser wheel is turned by the drive wheel.

The drive wheel, the dispenser wheel, the push arm and any other parts of the sweeping slurry dispenser system may be fabricated of a rigid material that does not generate contaminating particles. One of such suitable material is aluminum or stainless steel.

The present invention utilizes a cam and lever arrangement wherein the cam is driven by a motor at a suitable rotational speed, i.e., between about 1 RPM and about 60 RPM, such that a circular movement of the rotational motor can be changed to a site-to-site movement of the slurry dispensing nozzle. As a result, the slurry dispensing nozzle sweeps from edges of the polishing pad to the center of the polishing pad. To enable a uniform distribution of the slurry solution.

Problems solved and advantages provided by the present invention novel apparatus are numerous. For instance, the present invention novel apparatus enables the use of slurry in a more efficient manner; capable of producing a polishing noise at a lower volume; capable of avoiding wafer from mechanical cracking during the polishing process and capable of eliminating wafer slipping out during constant CMP process.

In the present invention novel apparatus, a cam of oval shape and a motor are used to drive a slurry delivery arm. The slurry delivery arm moves in a reciprocating manner from an edge portion of the polishing pad to a center of the pad. The sweeping profile of the slurry dispensing nozzle is the same as the polishing head. There is thus uniform distribution of a slurry solution on the pad and furthermore, the slurry solution can be utilized in a more efficient manner. The other advantages of the present invention is to avoid mechanical cracking during the polishing process and to reduce the polishing noise when the wafer is polished on a pad with deep grooves.

Figure 3A:
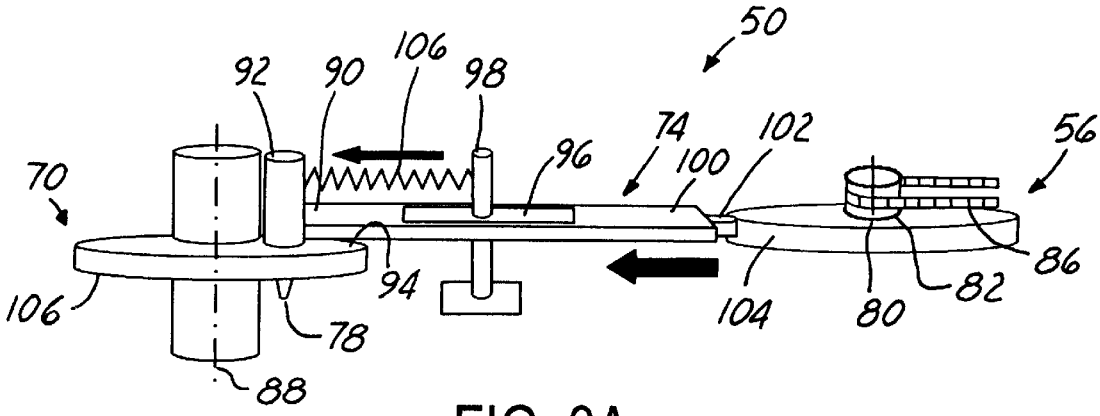
FIG. 3A is a perspective view of a present invention apparatus with the spring in a fully extended position.
Figure 3B:
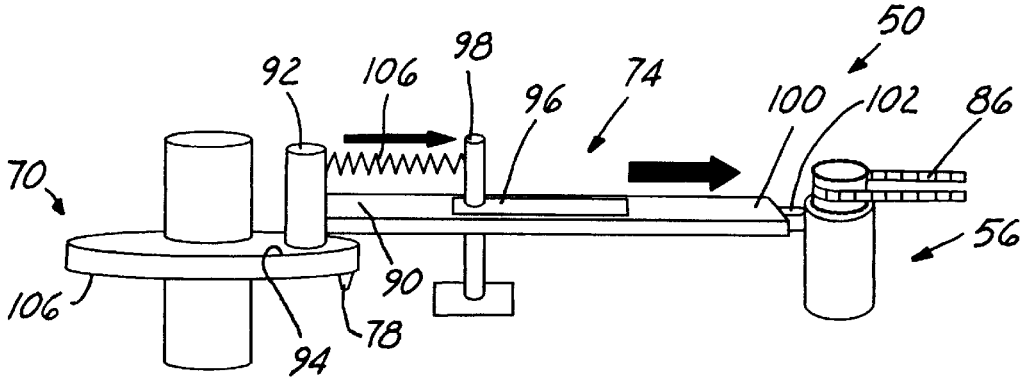
FIG. 3B is a perspective view of the present invention sweeping slurry dispensing device with the spring in a fully compressed position.

Referring now to FIG. 3A, wherein a perspective view of the present invention sweeping slurry dispensing apparatus 50 is shown. The sweeping slurry dispensing apparatus 50 is constructed by a drive wheel 56 of an oblong shape, such as an oval shape as shown in FIGS. 3A and 3B. The apparatus 50 further includes a dispenser wheel 70, a push arm 74 and a slurry dispensing nozzle 78.

The drive wheel 56 of oval shape turns on a fixed center axis 80 which has a rotor 82 mounted thereon for driving by a belt 86 by a motor (not shown) the drive wheel 56 has a first diameter D1 and a second diameter D2 (shown in FIG. 5A) wherein the first diameter D1 is at least 50% larger than the second diameter D2. An oval-shaped wheel is thus formed. In most embodiments, the first diameter may be between about 50% and about 900% larger than the second diameter. A suitable ratio between the first diameter and the second diameter may be between 2:1 and about 8:1.

The dispenser wheel 70 is formed of circular shape that turns on a fixed center axis 88 when driven by a push arm 74 with a first and 90 pivotally engaging a shift 92 mounted on the outer periphery 94 of the dispenser wheel 70. The center axis 88 of the dispenser wheel is fixed to the CMP apparatus such that the dispenser wheel can only rotate but cannot be moved.

The push arm 74 is formed of elongated shape with a hollow center slot 96 for engaging a die pin 98 that is fixedly attached to the CMP apparatus. The first end 90 of the push arm 74 is pivotally attached to the outer periphery 94 of the dispenser wheel 70, and a distal second end 100 is equipped with a roller 102 for rollingly engaging in outer surface 104 of the oval-shaped drive wheel 56. The push arm 74 is further equipped with a spring 106 that is attached between the guide pin 98 and the shaft 92 on the dispenser wheel 70 to facilitate the turning of the dispenser wheel 70. The push arm 74 can be suitably fabricated in a rigid material that does not produce contaminating particulars. A suitable rigid material is aluminum or stainless steel.

A motor means (not shown) is used to rotate the drive wheel 56 by the drive belt 86 through the rotor 82 located on the drive wheel 56. A suitable rotational speed is between about 1 RPM and about 60 RPM, and preferably between about 5 RPM and about 20 RPM.

A slurry dispensing nozzle 78 is attached to a bottom surface 108 of the drive wheel 70 and fed through a slurry dispensing tube (not shown) from a slurry reservoir (not shown). The slurry dispensing nozzle 78 dispenses a slurry solution in an arcuate path when the dispenser wheel 70 is turned by the drive wheel 56 in a cam and lever manner.

Figure 4:
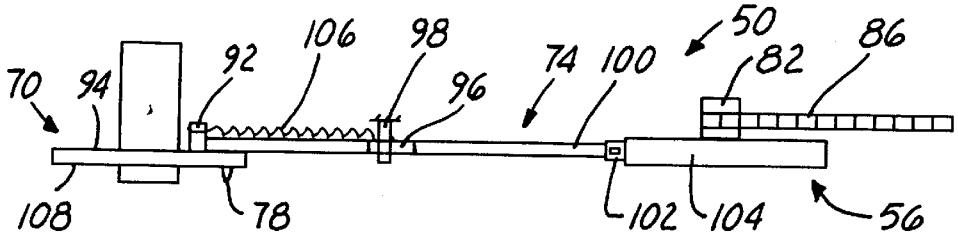
FIG.4 is a cross-section view of the present invention sweeping slurry dispensing device.

A cross-sectional view of the present invention novel sweeping slurry dispensing device 50 is shown in FIG. 4 illustrating the essential components of the drive wheel 56, the dispenser wheel 70, the push arm 74, the guide pin 98, the shaft 92 and the spring 106.

Figure 5A:
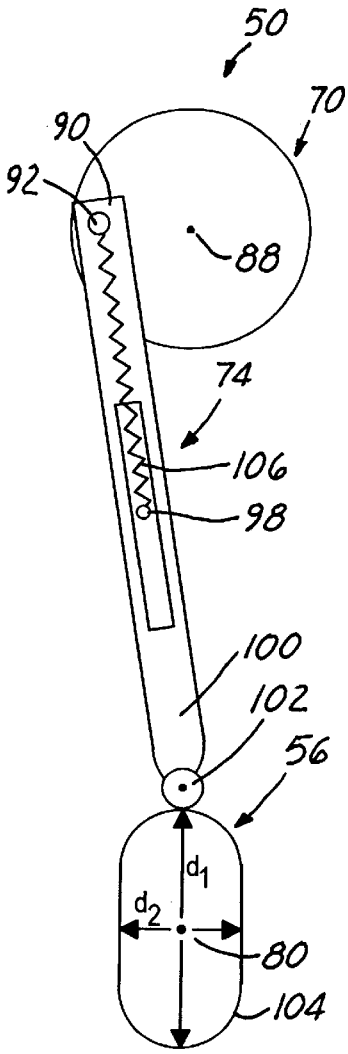
FIG. 5A is a top view of the present invention sweeping slurry dispensing device with the shaft on the dispenser wheel at a 9 o'clock position.
Figure 5B:
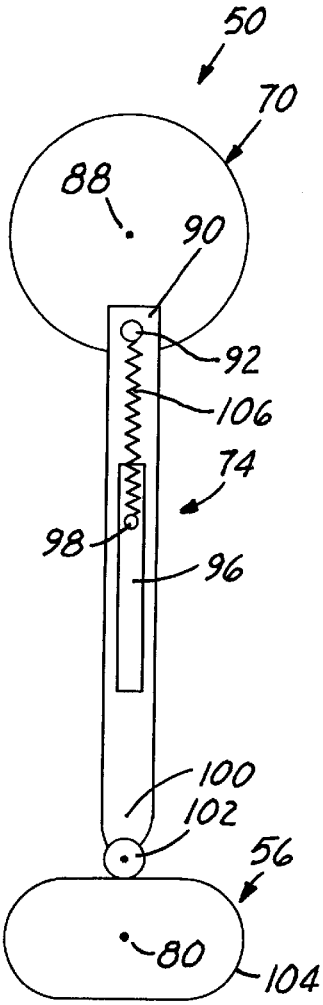
FIG. 5B is a top view of the present invention sweeping slurry dispensing device with the shaft on the dispenser wheel at a 6 o'clock position.
Figure 5C:
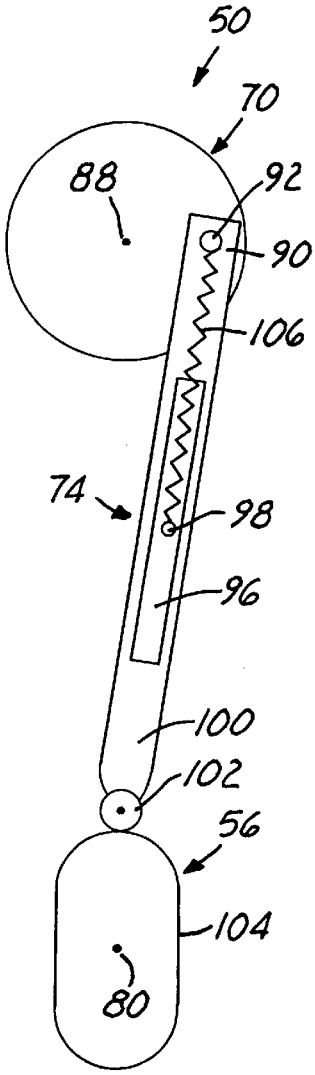
FIG. 5C is a top view of the present invention sweeping slurry dispensing device with the shaft on the dispenser wheel at a 3 o'clock position.

The operation of the present invention novel sweeping slurry dispensing device 50 can be described as follows and shown in FIGS. 5A, 5B and 5C. FIG. 5A indicates the first end 90 of the push arm 74 at a 9 o'clock position. FIG. 5B shows the first end 90 of the push arm 74 at a 6 o'clock position, while FIG. 5C shows the first end 90 of the push arm 74 at 3 o'clock position. By rotating the shaft 92 on the dispenser wheel 70 from a 9 o'clock position (FIG. 5A) to a 3 o'clock position (FIG. 5C), the slurry dispensing nozzle 78 is also turned in an arc, i.e., in a half-circular path from the 9 o'clock position to the 3 o'clock position. A slurry solution is therefore dispensed in the half-circular path on the top surface of a polishing pad (not shown) such that the slurry solution can be uniformly spread on the top surface of the pad. By suitably adjusting the size of the dispenser wheel 70, for instance making it larger, a longer slurry dispensing path can be achieved. Conversely, by using a smaller dispenser wheel 70, a shorter slurry dispensing path can be achieved. The spring 106 connecting between shaft 92 and the guide pin 98 facilitates the turning of the dispenser wheel 70. For instance, as shown in FIG. 5A, the spring 106 is in a fully extended position when the shaft 92 is at the 9 o'clock position such that the push arm 74 tends to turn the dispenser wheel 70 in a counter clockwise position to return the shaft 92 to a 6 o'clock position, such as that shown in FIG. 5B. Similarly, when the shaft 92 is at the 3 o'clock position, the spring 106 is again in a fully extended manner to urge the push arm 74 to return to the 6 o'clock position. Conversely, at the 6 o'clock position shown in FIG. 5B, the spring 106 is in a fully compressed position such that it urges the dispenser wheel 70 to turn either clockwise or counter-clockwise to facilitate the motion of the dispenser wheel 70 by the motor (not shown) that drives the drive wheel 56.

The present invention novel sweeping slurry dispensing device for using a chemical mechanical polishing process for the uniform distribution of a slurry solution on top of a polishing pad has therefore been amply described in the above description and in the appended drawings of FIGS. 3A–5C.

While the present invention has been described in an illustrative manner, it should be understood that the terminology used is intended to be in a nature of words of description rather than of limitation.

Furthermore, while the present invention has been described in terms of preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A sweeping slurry dispenser in a chemical mechanical polishing apparatus comprising:

a drive wheel of shape that turns on a fixed center axis, said wheel first having a first diameter and a second diameter perpendicular to each other, said first diameter being at least 50% larger than said second diameter;

a dispenser wheel of circular shape that turns on a fixed center axis when driven by a push arm with a first end pivotally engaging a shaft on an outer mounted periphery of the dispenser wheel;

a push arm of elongated shape having a hollow center slot therein for engaging a guide pin fixedly attached to said CMP apparatus, a first end pivotally attached to said outer periphery of the dispenser wheel and a distal second end equipped with a roller for rollingly engaging an outer surface of said oval shaped drive wheel, said push arm further equipped with a spring attached between said guide pin and said shaft on said dispenser wheel to facilitate the turning of the dispenser wheel;

a motor means for rotating said drive wheel on said fixed center axis at a preset rotational speed; and a slurry dispensing nozzle attached to a bottom surface of said drive wheel for dispensing a slurry solution in an arcuate path when said dispenser wheel is turned by said drive wheel.

2. A sweeping slurry dispenser in a CMP apparatus according to claim 1, wherein said first diameter is between about 50% and about 90% larger than said second diameter.

3. A sweeping slurry dispenser in a CMP apparatus according to claim 1, wherein a ratio of said first diameter and said second diameter is between about 2:1 and about 8:1.

4. A sweeping slurry dispenser in a CMP apparatus according to claim 1, wherein said drive wheel having a thickness sufficiently large for said roller attached to said push arm to roll on an edge portion of the drive wheel.

5. A sweeping slurry dispenser in a CMP apparatus according to claim 1, wherein said spring is in a fully extended state when said shaft for fixing the position of said first end of the push arm is in a 3 o'clock or in 9 o'clock position.

6. A sweeping slurry dispenser in a CMP apparatus according to claim 1, wherein said spring is in a fully compressed state when said shaft for fixing the position of said first end of the push arm is in a 6 o'clock position.

7. A sweeping slurry dispenser in a CMP apparatus according to claim 1, wherein said slurry dispensing nozzle traverses in a half-circular path when said dispenser wheel is turned by said drive wheel.

8. A sweeping slurry dispenser in a CMP apparatus according to claim 1, wherein said slurry dispensing nozzle traverses in a path that is substantially similar to a path of a polishing head that holds a wafer to be polished therein.

9. A sweeping slurry dispenser in a CMP apparatus according to claim 1, wherein said preset rotational speed is between about 1 RPM and about 60 RPM.

10. A sweeping slurry dispenser in a CMP apparatus according to claim 1, wherein said drive wheel is fabricated of aluminum.

11. A sweeping slurry dispenser in a CMP apparatus according to claim 1, wherein said drive wheel has a first diameter of about 6 inches and a second diameter of about 2 inches.

12. A sweeping slurry dispenser in a CMP apparatus according to claim 1, wherein said dispenser wheel has a diameter between about 4 inches and about 12 inches.

13. A sweeping slurry dispenser in a CMP apparatus according to claim 1, wherein said dispenser wheel is fabricated of aluminum.

14. A sweeping slurry dispenser in a CMP apparatus according to claim 1, wherein said push arm has a length of between about 4 inches and about 12 inches.

15. A sweeping slurry dispenser in a CMP apparatus according to claim 1, wherein said push arm is fabricated of aluminum.

* * * * *